US006645002B1

(12) United States Patent
Lee

(10) Patent No.: US 6,645,002 B1
(45) Date of Patent: Nov. 11, 2003

(54) IDC CONNECTOR ASSEMBLY

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/159,534

(22) Filed: May 31, 2002

(51) Int. Cl.[7] ..... H01R 12/24
(52) U.S. Cl. ..... 439/497; 439/404; 439/405
(58) Field of Search ..... 439/497, 404, 439/405, 492, 417, 108, 92

(56) References Cited

U.S. PATENT DOCUMENTS 4,925,401 A * 5/1990 Fogg et al. ..... 439/465
5,902,147 A * 5/1999 Jochen et al. ..... 439/497
6,033,238 A * 3/2000 Fogg et al. ..... 439/108
6,077,105 A * 6/2000 Jochen et al. ..... 439/497
6,193,545 B1 * 2/2001 Lee et al. ..... 439/497

* cited by examiner

*Primary Examiner*—Javaid H. Nasri
(74) *Attorney, Agent, or Firm*—Wei Te Chung

(57) ABSTRACT

An IDC connector assembly (100) includes an IDC connector (1) and a flat cable (9) terminated by the IDC connector. The cable comprises a number of alternately arranged signal and grounding wires (91, 92), and four power wires (90) positioned at one side of the signal and grounding wires. The pitch between adjacent power wires is double the pitch between a signal wire and an adjacent grounding wire. The IDC connector has a number of terminals (30) which correspond in position with the signal and power wires and a pair of grounding plates (41, 42) formed with bifurcated projections (411, 421) corresponding in position with the grounding wires and selected signal wires which require grounding signals.

2 Claims, 5 Drawing Sheets

IDC CONNECTOR ASSEMBLY

BACKGROUND OF THE INVENTION

1. Field of the Invention

The present invention relates to an electrical connector assembly, and particularly to an Insulation Displacement Connection (IDC) connector assembly for terminating a flat ribbon cable and for mating with a complementary connector mounted on a printed circuit board.

2. Description of Prior Art

Introduced in the 1980s, the parallel Advanced Technology Attachment (ATA) interface has been the dominant PC storage interface protocol for desktop and portable computers. The high-performance Ultra ATA-100 (also referred to as Ultra ATA direct memory access Mode 5), as the latest-generation parallel ATA interface, increases data transmitting speed up to 100 MB/sec between a 3.5 inch hard disk drive and system memory of a computer. However, there is no Ultra ATA interface for a 2.5 inch hard disk drive used in practical applications, such as a 2.5 inch hard disk drive used in a slim type desktop computer.

Currently available technology on the market does not meet the requirements for an Ultra ATA-100 interface used with a 2.5 inch hard disk drive. Cross talk between signal wires during massive, high speed data transmission, influences the signal integrity and speed, and thus makes current connectors unsuitable. Moreover, with the current high data transmitting speed requirement between electronic components, connectors meeting a high power requirement are also desired.

Related IDC connectors are described in U.S. Pat. Nos. 6,193,545, 4,925,401, 6,033,238, 6,077,105, and 5,902,147.

An improved IDC connector assembly is desired to overcome the disadvantages of the prior art.

BRIEF SUMMARY OF THE INVENTION

Accordingly, a first object of the present invention is to provide an electrical IDC connector assembly useable in a high performance signal transmission environment.

A second object of the present invention is to provide an Ultra ATA-100 connector for use with 2.5 inch disk drives.

In order to achieve the above-mentioned objects, an electrical connector assembly in accordance with the present invention includes an IDC connector and a flat ribbon cable terminated to the IDC connector. The flat ribbon cable comprises a number of alternately positioned signal and grounding wires, and four power wires attached adjacent to the signal and grounding wires. The pitch between adjacent power wires is double the pitch between a signal wire and an adjacent grounding wire. The IDC connector has a number of terminals received in an elongated, insulative base, and a cover attachable to the insulative base for interposing the flat ribbon cable therebetween. The terminals are arranged in a staggered subsequence with each other in two rows corresponding to the signal and power wires of the flat ribbon cable. Each terminal has an IDC end for piercing the insulation of a corresponding wire of the flat ribbon cable, and a receptacle end for engaging with a complementary connector. The IDC connector also has a pair of grounding plates attached therein. The grounding plates each form a plurality of bifurcated projections extending therefrom and positioned to correspond with the position of the grounding wires and selected signal wires.

Other objects, advantages and novel features of the invention will become more apparent from the following detailed description of the present embodiment when taken in conjunction with the accompanying drawings.

DETAILED DESCRIPTION OF THE INVENTION

Figure 1:
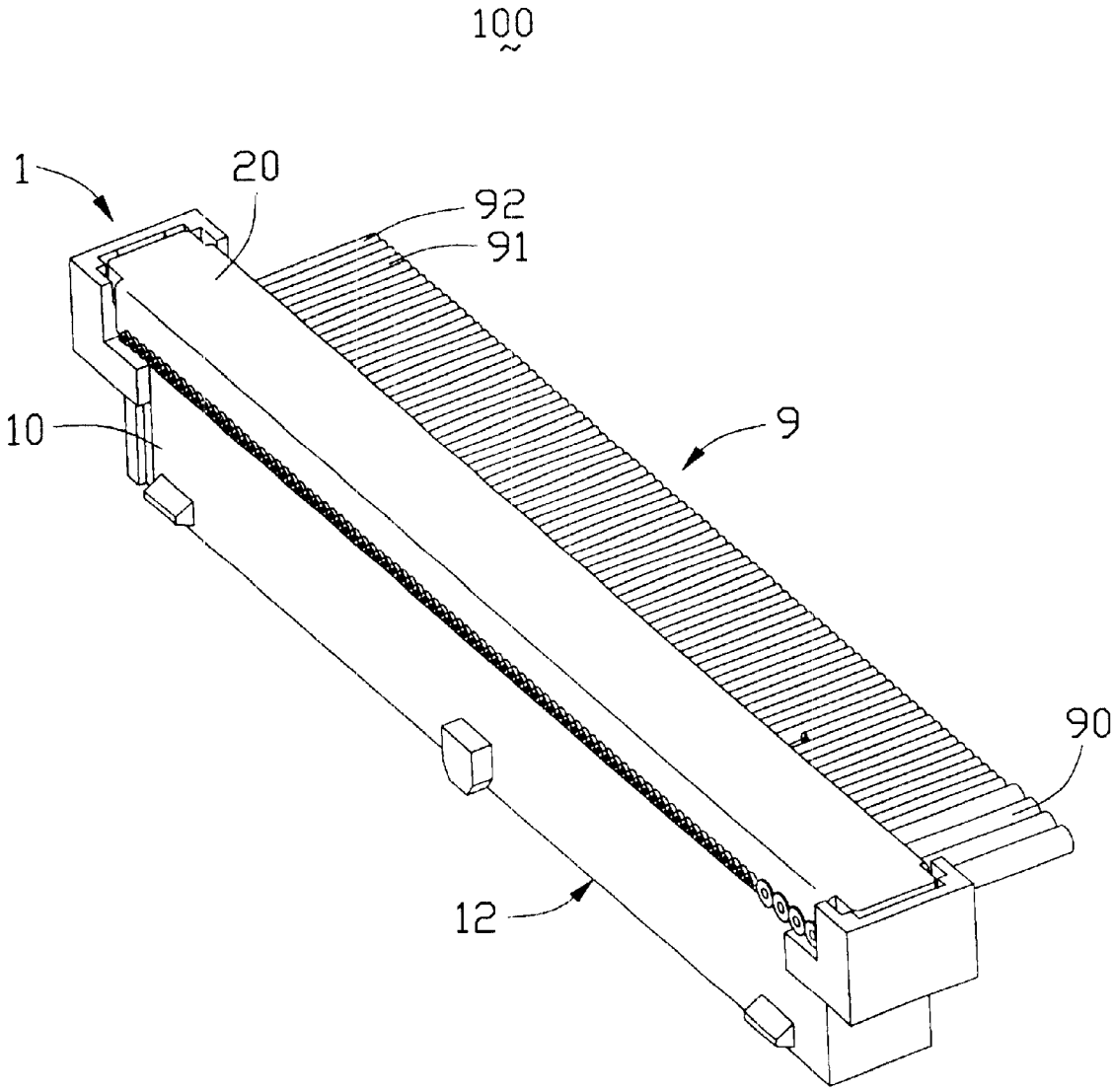
FIG. 1 is a perspective view of an IDC connector assembly in accordance with the present invention.

Reference will now be made to the drawing figures to describe the present invention in detail.

Figure 2:
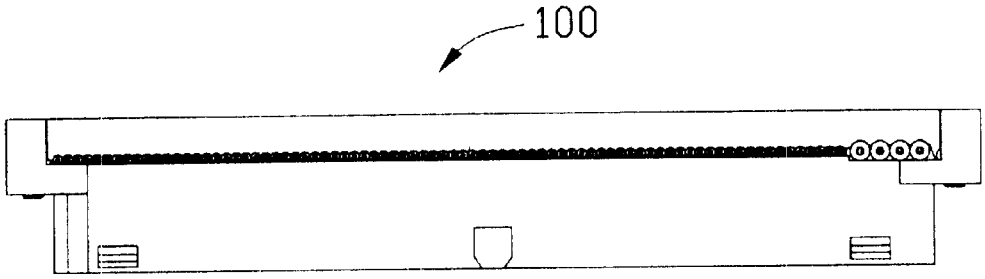
FIG. 2 is a front plan view of the connector assembly of FIG. 1.
Figure 3:
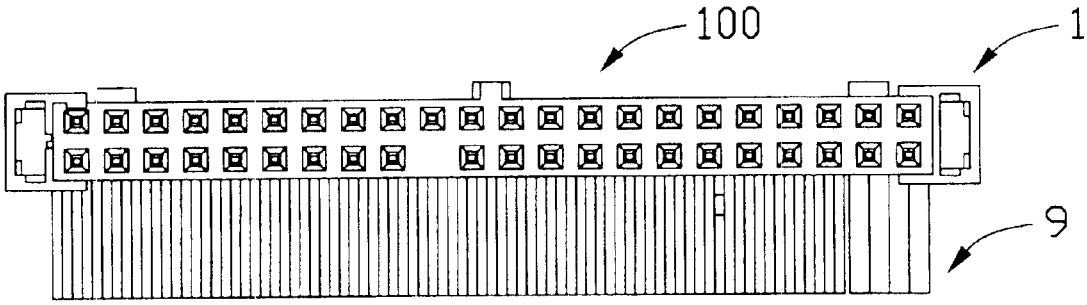
FIG. 3 is a bottom plan view of the connector assembly of FIG. 1.

Referring to FIGS. 1–3, an electrical connector assembly 100 in accordance with the present invention includes an electrical connector 1 and a flat ribbon cable 9 terminated to the electrical connector 1.

Figure 4:
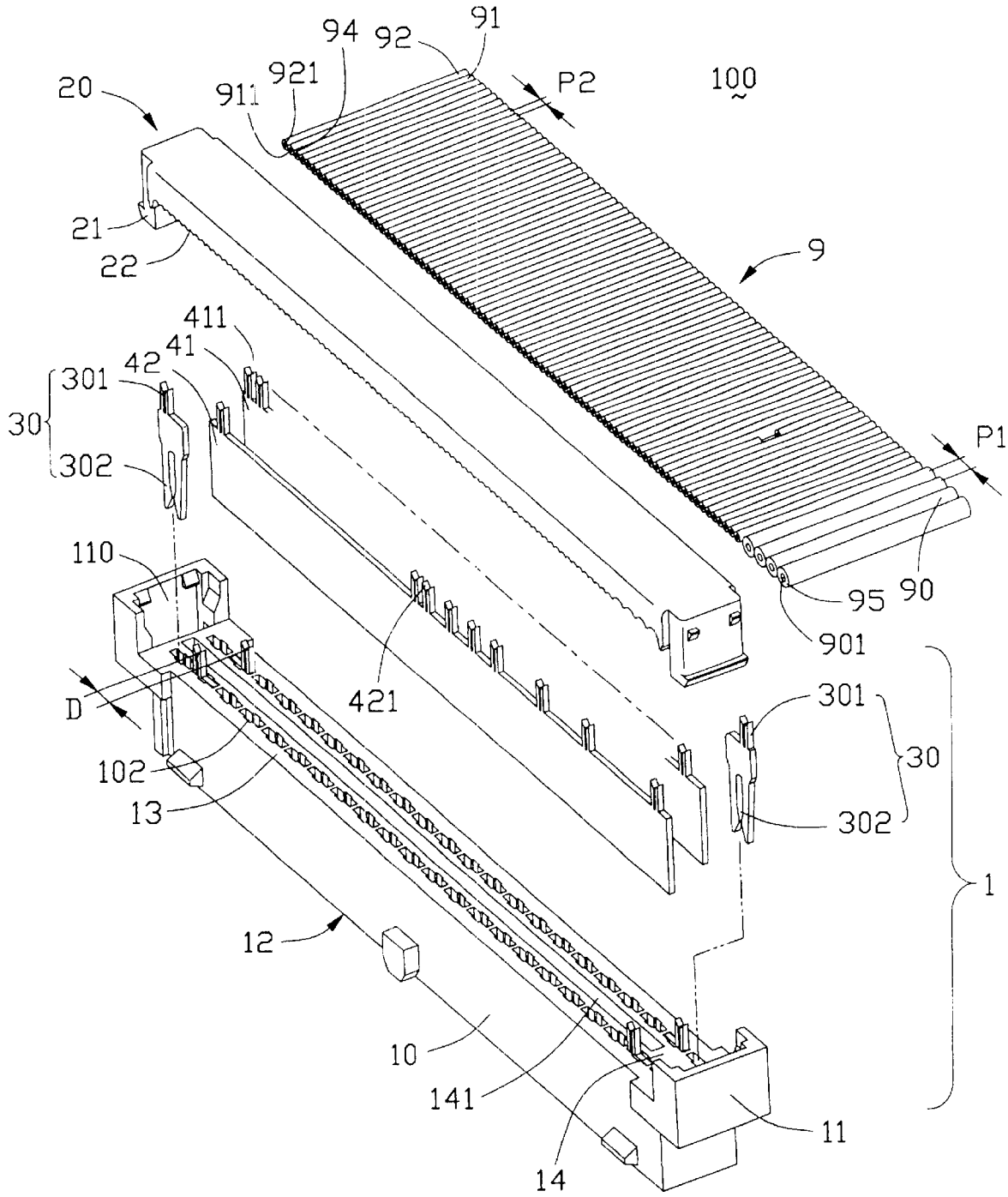
FIG. 4 is an exploded, perspective view of the IDC connector assembly of FIG. 1.
Figure 5:
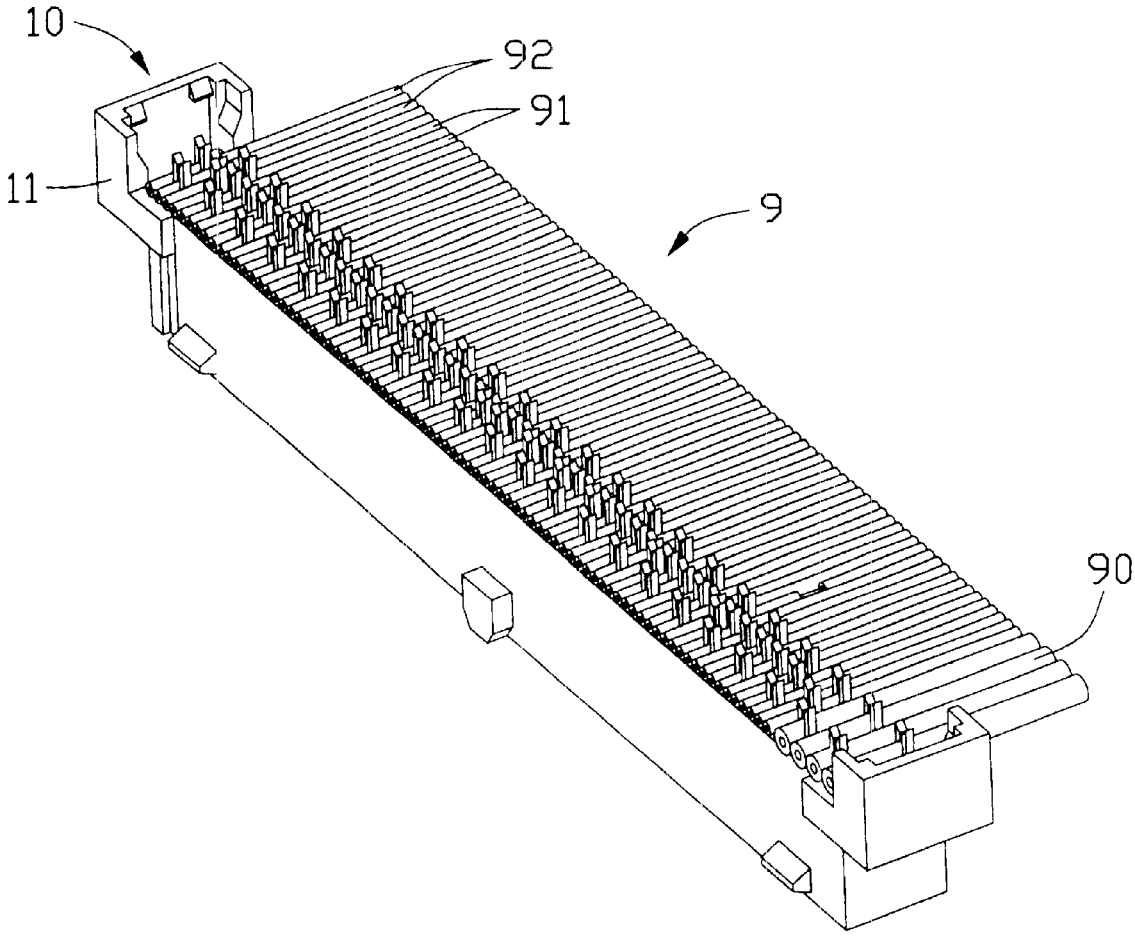
FIG. 5 is a view similar to FIG. 1, but with a cover being removed therefrom.
Figure 6:
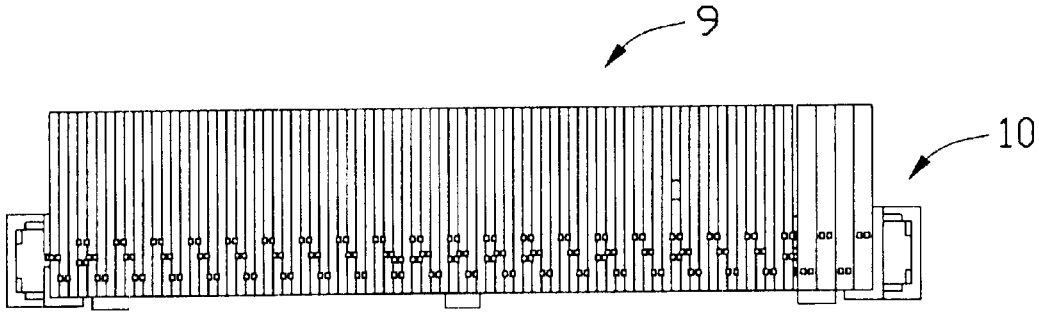
FIG. 6 is a top plan view of FIG. 5.
Figure 7:
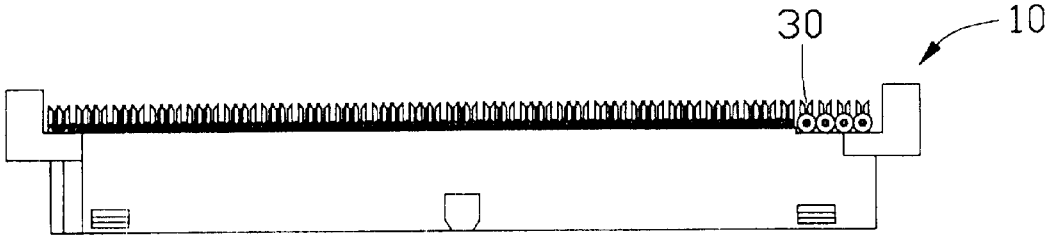
FIG. 7 is a front plan view of FIG. 5.

Turning to FIG. 4, the electrical connector 1 comprises an elongated, insulative base 10, a plurality of conductive terminals 30 received in the insulative base 10, two grounding plates 41, 42 attached to the insulative base 10, and an insulative cover 20 cooperating with the insulative base 10. The elongated, insulative base 10 has a pair of ear portions 11 extending from opposite ends thereof, each ear portion 11 defining a receiving opening 110 therein for receiving a corresponding part of the cover 20. The relationship of the cover 20 and the insulative base 10 will be described in detail hereinafter.

The insulative base 10 also forms an engaging surface 13 on a top side and a mating surface 12 on a bottom side. A plurality of terminal receiving holes 102 is defined from the engaging surface 13 to the mating surface 12, each terminal receiving hole 102 receiving a corresponding conductive terminal 30 therein. In the embodiment illustrated, the terminal receiving holes 102 are arranged in two parallel rows which are separated by a middle portion 14 of the insulative base 10. The middle portion 14 defines an elongated groove 141 therethrough for receiving the two conductive grounding plates 41, 42.

The insulative cover 20 is assembled onto the insulative base 10 to fix the flat ribbon cable 9 therebetween. A pair of downwardly extending legs 21 project from opposite ends of the cover 20 and engages with corresponding receiving openings 110 of the ear portion 11 of the insulative base 10 for securing the cover 20 on the base 10. The cover 20 has a plurality of recesses 22 defined on an underside thereof for tightly accommodating respective wires of the flat ribbon cable 9 therein.

Together referring to FIGS. 4–7, the flat ribbon cable 9 includes a plurality of parallel signal wires 91 and grounding wires 92, which are alternated arranged with each other to suppress cross-talk between adjacent signal wires 91. The signal and grounding wires 91, 92 are substantially identical to each other, both being of a same size. Each wire 91, 92 comprises a conductor 911, 921 and a cable insulation 94 wrapped about the conductor 911, 921. The flat ribbon cable 9 also has four power wires 90 positioned at one side of the alternatingly arranged signal and grounding wires 91, 92. The power wires 90 are of a larger size than the signal and grounding wires 91, 92. The four power wires 90 each comprise a conductor 901 and a cable insulation 95. It should be noticed that a radial dimension of the power wires 90 is different from that of the signal and grounding wires 91, 92. In the depicted embodiment, for example, the adjacent power wires 90 have a pitch, which is labeled as "P1" in the drawing, about twice that of the adjacent signal and grounding wires 91, 92, whose pitch is labeled as "P2".

The plurality of conductive terminals 30 are received within the two rows of terminal receiving holes 102. The terminal receiving holes 102 are arranged in a staggered pattern so that the terminals 30 in a back row alternated appear between terminals 30 in a front row, when the connector 1 is viewed in the front plan view of FIG. 7. The distance between a terminal 30 in a first row and an adjacent terminal 30 in a second row, which is designated with reference character "D" in FIG. 4, is substantially equal to the distance between two adjacent signal conductors 911 of the flat ribbon cable 9. In other words, the distance D is twice the pitch P2.

Preferably, the conductive terminals 30 are substantially identical, each conductive terminal 30 being positioned to engage with a corresponding signal or power wire 91, 90 according to the application requirements. Each terminal 30 comprises an IDC end 301 partially projecting beyond the engaging surface 13 and a receptacle end 302 extending to the mating surface 12 within the terminal receiving hole 102. The IDC end 301 is adapted for piercing into the cable insulation 94, 95 of the signal wires 91 and the power wires 90, and electrically connecting with the corresponding conductor 911, 901. The receptacle ends 302 are configured to mechanically and electrically engage with a complementary connector (not shown).

It can be readily seen from FIG. 4 that the two conductive grounding plates 41, 42 are provided with bifurcated projections 411, 421 which extend parallel to the IDC ends 301 of the conductive terminals 30. The bifurcated projections 411 of the first grounding plate 41 correspond with the grounding conductors 921 of the grounding wires 92 of the flat ribbon cable 9, while the bifurcated projection 421 of the second grounding plate 42 correspond with selected signal conductors 911 which require a grounding signal or ground potential in application. An insulation displacement occurs on the grounding conductors 921 and the selected signal conductors 911 and the bifurcated projections 411, 421 of the two conductive grounding plates 41, 42 thereby establishing an electrical connection with the corresponding conductors 921, 911 when the cover 20 is attached to the insulative base 10. Preferably, an electrical connection is also established between the first and second conductive grounding plates 41, 42.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a flat cable having a plurality of parallel signal, grounding and power wires positioned side by side, wherein said signal and grounding wires are alternately arranged with each other; and an electrical connector terminating said flat cable and adapted for mating with a complementary connector, comprising:

an insulative base defining therein an elongated groove;

a plurality of conductive terminals located at opposite sides of said elongated groove, each conductive terminal comprising a first end, some first ends electrically connecting to said signal wires and the other first ends electrically connecting to said power wires of said flat cable, and a second end for electrically mating with the complementary connector;

a first grounding plate received in said elongated groove of said insulative base, the first grounding plate having a plurality of bifurcated projections extending upwardly therefrom, each said bifurcated projection being arranged to correspond in position with a position of a corresponding grounding wire of said flat cable to establish an electrical connection therewith;

a second grounding plate received in said elongated groove of said insulative base and electrically connecting to said first grounding plate, said second grounding plate having at least one bifurcated projection extending upwardly therefrom, said at least one bifurcated projection corresponding in position with a selected signal wire which requires a grounding signal in an application, said bifurcated projection establishing an electrical connection therewith; and a cover attachable onto said insulative base for firmly and securely fixing said flat cable between the cover and the insulative base; wherein said signal and grounding wires are identical with each other; wherein the power wires are adjacent to each other and a pitch between adjacent power wires is twice a pitch between a signal wire and an adjacent grounding wire; wherein said insulative base defines two rows of terminal receiving holes beside said elongated groove, each hole receiving a corresponding terminal therein; wherein a diameter of said power wire is 1.0 mm while a diameter of said signal and grounding wires is 0.5 mm.

2. An electrical connector assembly adapted for using with a 2.5 inch hard disk drive, comprising:

a flat ribbon cable comprising a row of alternately arranged signal wires and grounding wires, and power wires positioned at one side of said row of signal and grounding wires, each of said signal, grounding, and power wires including a conductor and a cable insulation wrapping around said conductor; and an electrical connector terminating said flat ribbon cable and being adapted for mating with a complementary connector, comprising:

an insulative base defining a number of terminal receiving holes arranged in two rows along a lengthwise direction of the base, terminal receiving holes of one row being offset in an elongate direction of said insulative base from terminal receiving holes of the other row one half a distance between two adjacent holes in a same row;

a plurality of conductive terminals being received in said terminal receiving holes, said terminals corresponding in position with positions of corresponding signal wires and power wires, and being adapted to establish an electrical connection between said signal and power conductors and the complementary connector;

a grounding portion disposed within said insulative base and formed with bifurcated projections extending upwardly therefrom, said bifurcated projections being arranged in positions corresponding to and electrically connect with said grounding wires and selected signal wires, said selected signal wires requiring grounding potential or a grounding signal in a desired application; and a cover attachable onto said insulative base for firmly and securely interposing said flat cable between the cover and the insulative base; wherein said power wires have a diameter twice that of said signal and grounding wires; wherein said conductive terminals are identical, and each has an IDC end for piercing into said cable insulation of a corresponding signal wire or power wire, and a mating end for electrically connecting with the complementary connector; wherein said grounding portion includes a first grounding part and a second grounding part, said first grounding part being formed with bifurcated projections corresponding in position with positions of said grounding wires of said flat ribbon cable, said second grounding part being formed with at least one bifurcated projection corresponding in position with the position of selected signal wires according to the requirements of an application; wherein said insulative base further defines a groove between said two rows of terminal receiving holes for receiving therein said grounding portion; wherein a diameter of said power wires is 1.0 mm while a diameter of said signal and grounding wires is 0.5 mm.

* * * * *